US007676996B2

(12) United States Patent
Teodorovich

(10) Patent No.: US 7,676,996 B2
(45) Date of Patent: Mar. 16, 2010

(54) APPARATUS AND METHOD FOR DOOR AND WINDOW HEAD FLASHING

(76) Inventor: Mishko Teodorovich, 6410 Yaupon Dr., Austin, TX (US) 78759

( * ) Notice: Subject to any disclaimer, the term of this patent is extended or adjusted under 35 U.S.C. 154(b) by 1252 days.

(21) Appl. No.: 11/143,419

(22) Filed: Jun. 2, 2005

(65) Prior Publication Data

US 2005/0268569 A1 Dec. 8, 2005

Related U.S. Application Data

(60) Provisional application No. 60/576,164, filed on Jun. 2, 2004.

(51) Int. Cl.

| | |
|---|---|
| ***E04D 3/38*** | (2006.01) |
| ***E04C 3/02*** | (2006.01) |
| ***E06B 7/14*** | (2006.01) |
| ***E04B 1/70*** | (2006.01) |

(52) U.S. Cl. ..... 52/204.2; 52/60; 52/209; 52/302.6

(58) Field of Classification Search ..... 52/204.1, 52/204.2, 210, 212, 204.5, 209, 302.6, 211, 52/656.2, 656.5, 58, 60

See application file for complete search history.

(56) References Cited

U.S. PATENT DOCUMENTS

| | | | | |
|---|---|---|---|---|
| 2,043,049 | A * | 6/1936 | Ludden | 52/62 |
| 2,245,965 | A * | 6/1941 | Cunin | 52/215 |
| 2,292,459 | A * | 8/1942 | Martin | 52/204.2 |
| 3,451,178 | A * | 6/1969 | Beale | 52/210 |
| 4,228,630 | A * | 10/1980 | Englert et al. | 52/656.9 |
| 4,280,308 | A * | 7/1981 | Svensson | 52/98 |
| 4,335,550 | A * | 6/1982 | Johnson | 52/99 |
| 4,555,882 | A * | 12/1985 | Moffitt et al. | 52/209 |
| 5,348,066 | A | 9/1994 | Wilson et al. | |
| 5,815,986 | A * | 10/1998 | Laska | 52/62 |
| 5,884,435 | A * | 3/1999 | David et al. | 52/62 |
| 6,038,821 | A * | 3/2000 | Larson et al. | 52/97 |
| 6,119,416 | A * | 9/2000 | Larson | 52/212 |
| 6,371,188 | B1 * | 4/2002 | Baczuk et al. | 160/92 |
| 6,385,925 | B1 * | 5/2002 | Wark | 52/209 |
| 6,401,401 | B1 | 6/2002 | Williams | |

(Continued)

FOREIGN PATENT DOCUMENTS

| | | |
|---|---|---|
| GB | 2 270 534 A | 3/1994 |

(Continued)

*Primary Examiner*—Richard E Chilcot, Jr.
*Assistant Examiner*—Ryan D Kwiecinski
(74) *Attorney, Agent, or Firm*—Rick B. Yeager

(57) ABSTRACT

A window and door head flashing assembly is fabricated at a construction site to fit specific door or window widths. A center section which may be extruded with a sloped base, a rear flange, and a front lip. End caps may be provided to snap or glue on the center section. The end caps have a perpendicular fin which serves as an end dam to block the lateral movement of water. The assembly may be inverted for use as a sill pan. The center section may be cut to a desired length and installed over arched windows or doors by bending to shape as it is installed. For arched applications, a combination of rigid and flexible PVC may be coextruded to provide a desired cross sectional profile that is flexible enough to be bent around the arch, but stiff enough to retain its cross section for drainage.

7 Claims, 18 Drawing Sheets

U.S. PATENT DOCUMENTS

| | | | | |
|---|---|---|---|---|
| 6,725,617 | B2 * | 4/2004 | Cox | 52/408 |
| 7,222,462 | B2 * | 5/2007 | Ellingson | 52/62 |
| 2005/0144856 | A1 * | 7/2005 | Conlin | 52/58 |
| 2005/0166471 | A1 * | 8/2005 | Allen | 52/58 |
| 2007/0214738 | A1 * | 9/2007 | Koessler | 52/302.6 |

FOREIGN PATENT DOCUMENTS

| | | |
|---|---|---|
| WO | WO 01/71142 A | 9/2001 |

* cited by examiner

APPARATUS AND METHOD FOR DOOR AND WINDOW HEAD FLASHING

RELATED APPLICATIONS

This application is related to U.S. Provisional patent application No. 60/576,164, filed on Jun. 2, 2004, and claims priority from that application.

FIELD OF INVENTION

This invention relates to a door or window head flashing system, devices, and methods to direct moisture away from the inside of a structure.

BACKGROUND

It is desirable to provide window and door head flashing for directional drainage of water and moisture. It is desirable that the apparatus and method can be used for construction in all price ranges of housing, and for any door or window width. In one embodiment of the current invention, a head flashing is provided which can typically be manufactured by extrusion and either cut to a desired length to fit the door or window width, or used with other similar elements and connectors to establish a desired final length. End pieces and optional center joining elements may be provided for field assembly.

Copending U.S. patent application Ser. No. 10/730,414 by applicant describes a window sill pan or door sill pan flashing. The sill pan has an inclined base, window or door supports which can be extruded as part of the base unit, and end cap corner elements which can be snapped or otherwise attached to the base. Sill pan offsets provided in the rear sill pan wall and in the front flange create a flow path for water to drain from the sill. The base may be solid or hollow with window or door supports extending vertically through the base. The sill pan may be manufactured by extrusion, and end caps may be injection molded. The base may be fabricated from fiberglass, metal, or plastic. A window support means is provided in a horizontal orientation so that the base can be extruded.

It is desirable to provide a head flashing and jamb flashing system integrated to perform together that can be used for doors or windows of any length, height, or shape.

It is desirable to provide economical flashing devices that can be used in most construction. One way to provide a relatively low cost device is to extrude a base unit to achieve low cost manufacture. It is desirable in such applications to provide head flashing which can be extruded in relatively long lengths suitable to be cut in the field in order to accommodate different size windows and doors.

It is desirable to manufacture window and door sill flashing elements in an efficient and economical extrusion process, to supply the elements in relatively long lengths, and to cut the elements to a desired length at a construction site. This manufacturing and installation method may provide flashing elements that are more readily available to builders and which are more economical than purchasing prefabricated sizes from a supplier who is required to stock a large number of possible widths. This manufacturing and installation method eliminates the need for special ordering of head flashing for specific field dimensions.

Also, if an injection molding tool were required for each size, then relatively high volumes of each size would be required to pay for the tool. It is difficult to order and store many different sizes of flashing units for the variety of window and door dimensions which are used in construction. By designing the head flashing for manufacture by extrusion, a single extrusion tool and a single injection molding tool for end pieces can provide base units of a variety of lengths. In some embodiments, sections of base may be connected to establish a desired length. In other embodiments, the base may be cut to a desired length.

SUMMARY OF INVENTION

The current invention is for a window and door head flashing system and method, which used in combination with other devices and methods prevents water intrusion and accumulation around windows and doors. The SureSill HeadFlash™ is designed to discharge water above a window or door to the exterior of the building. In one embodiment, a head flash assembly is constructed from a center section and end caps. During installation, the center section, DrainShield™, is placed over the brick mould or is installed on top of the window or door. The end caps overlap the sides of the window or door. The end caps also prevent water build up above the window or door from going down the sides of the window or door. The center section and end caps may be provided in desired sizes or materials.

In some embodiments of the current invention, the device can be made in a low cost manufacturing operation by extrusion. In one embodiment, HeadFlash™, a head flashing assembly is made by combining extrusion and injection molding processes. The head flashing assembly typically includes insets to accept window flanges, nailing slots, a front flange, and a back flange. End caps can be snapped or otherwise attached to the base.

In another embodiment, the head flashing may be formed of a combination of rigid and flexible plastics, so that it can be easily formed over arched windows while retaining a desirable cross-sectional shape.

In some embodiments, the base can be extruded. In other embodiments, the base may be fabricated from fiberglass, metal, or molded plastic, and may not have a horizontal orientation.

In other metal or plastic embodiments, the head jam is provided as a center piece that can be cut to a desired length, and as end elements that can be snapped or glued to the center piece.

In one embodiment, an extruded base unit is cut to a desired length, and an installation tolerance is provided in end caps which slide onto the base unit.

BRIEF DESCRIPTION OF THE DRAWINGS

These and other objects and advantages of the present invention are set forth below and further made clear by reference to the drawings, wherein.

DETAILED DESCRIPTION OF EMBODIMENT

Water Management for Window Openings

FIGS. 1A-1G illustrate a comprehensive procedure for water management around a rough opening intended for a window or a door installation.

Figure 1A:
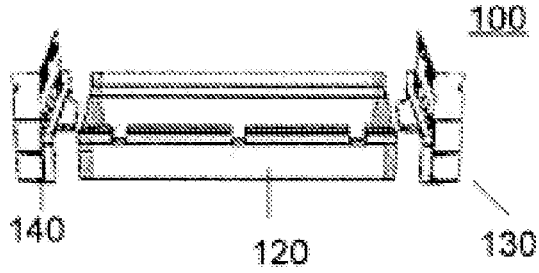
FIGS. 1A-1G is a comprehensive procedure for water management around a rough opening intended for a window or a door installation.

FIG. 1A shows the first step of a procedure. A SureSill™ sloped sill pan assembly kit 100 is provided, which comprises a center channel plate 120, a first end cap 130, a second end cap 140, and PVC cement. The rough opening of the window is measured, and the channel plate 120 is cut ¼ inch shorter than the rough opening. The end caps are installed, and the fit of the assembly 150 is checked. If the fit is good, then the end caps 130 and 140 are glued to the channel plate.

Figure 1B:
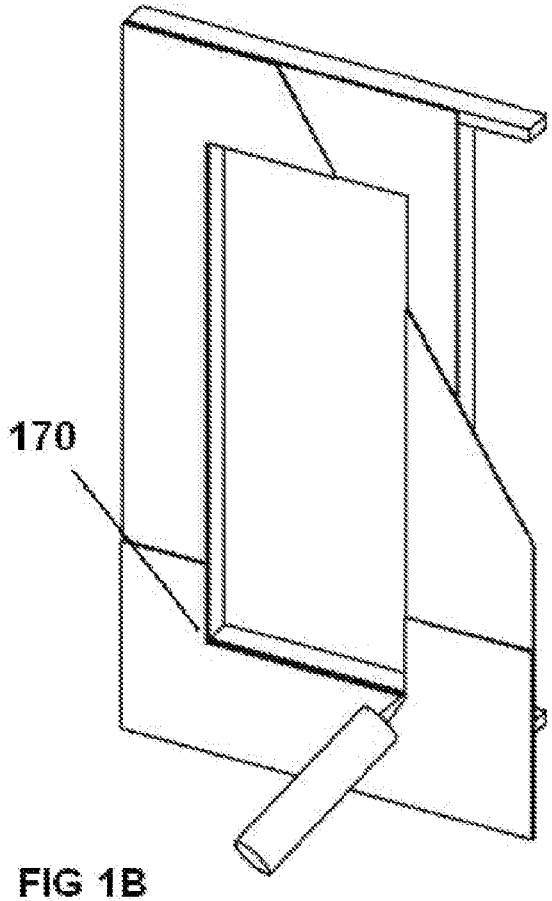

FIG. 1B shows the second step of the water management procedure. Waterproofing 170 is installed six inches above the plate over any sub floor area. An adhesive sealant is applied to the concrete, sub floor, or base plate. The waterproofing prevents water, if any, from causing damage or mold on the wood structure, and directs water, including condensation, down to sill pan flashing which then directs the water to the exterior of the building.

Figure 1C:
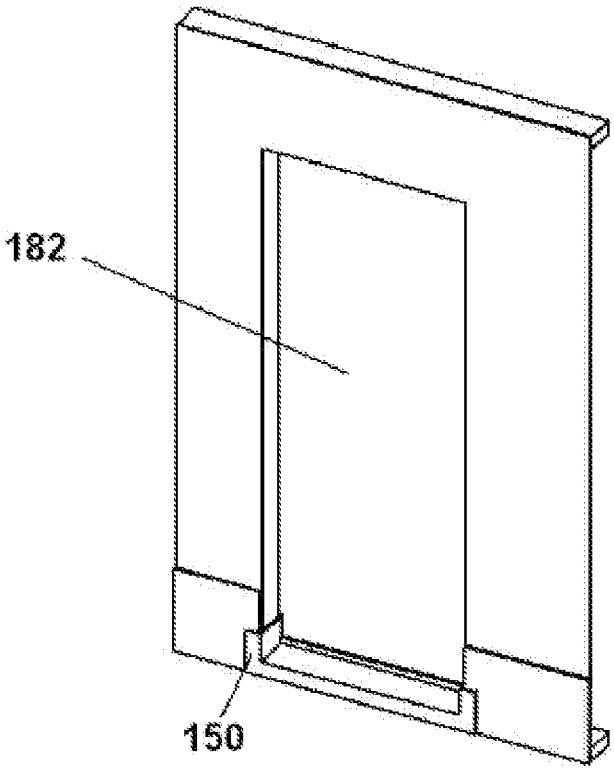

FIG. 1C shows the third step of a water management procedure. The Suresill pan assembly 150 is installed, plumbed, and leveled across the entire bottom portion of the rough opening 182, and secured to the rough opening by fasteners through slots provided in the end caps.

Figure 1D:
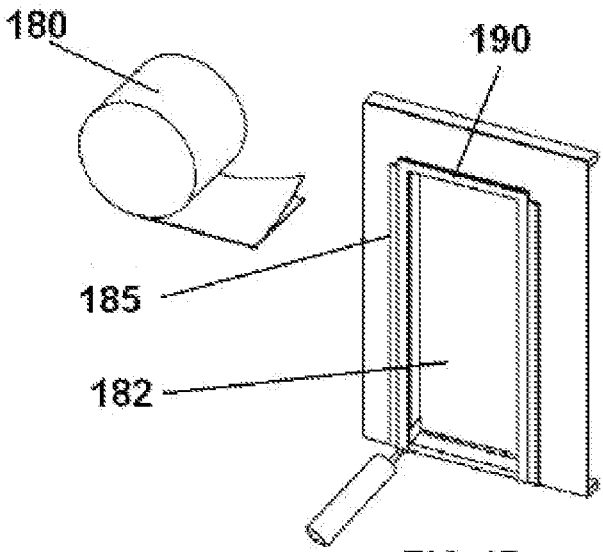

FIG. 1D shows the fourth step of a water management procedure. A self adhering flashing (SAF) 180 is applied on the rough jamb 182, and over the sill pan end caps 130 and 140. An adhesive sealant is applied to the jamb 185 and head 190. In this step, a waterproof tape is typically applied over the exterior plywood or other exterior sheeting and the window, prior to installation of a head flashing. The waterproof tape seals the side of the window and the joint of the window and the building, thereby preventing any moisture from intruding this way into the opening. Any moisture would be directed downwardly.

Figure 1E:
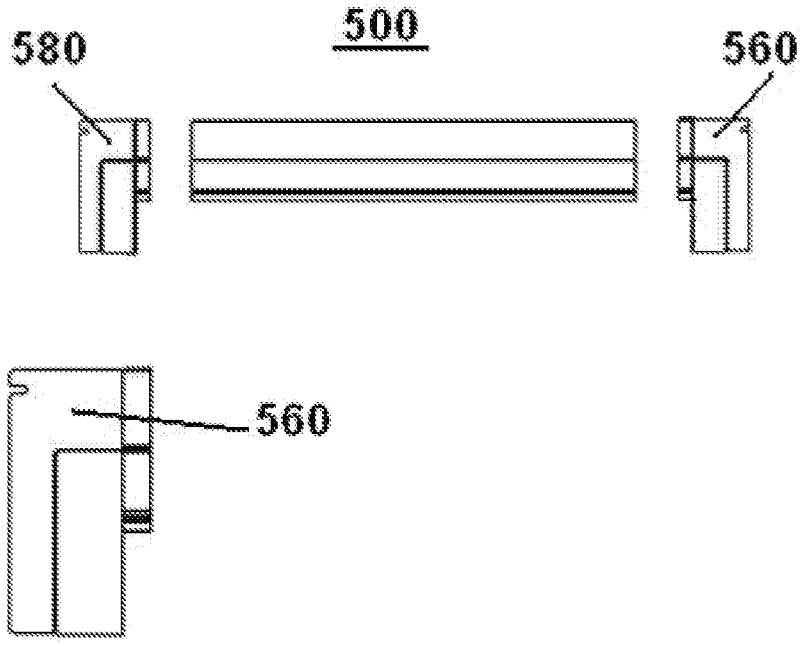

FIG. 1E shows the fifth step of a water management procedure. The exterior width of the window or door is measured. This measurement includes any brick molding. The DrainShield™ center piece 510 of the head flashing assembly 500 is cut to the measured exterior width. The end caps 560 and 580 are installed on the center piece 510, and the fit is checked before gluing the end caps. A PVC cement is applied to the contact surfaces of both the end caps and the center piece 510. The end caps are slid into place, excess glue is wiped off, and the parts are held in place for one minute. The assembly of the center piece and the end caps forms a SureSill HeadFlash™ 500.

Figure 1F:
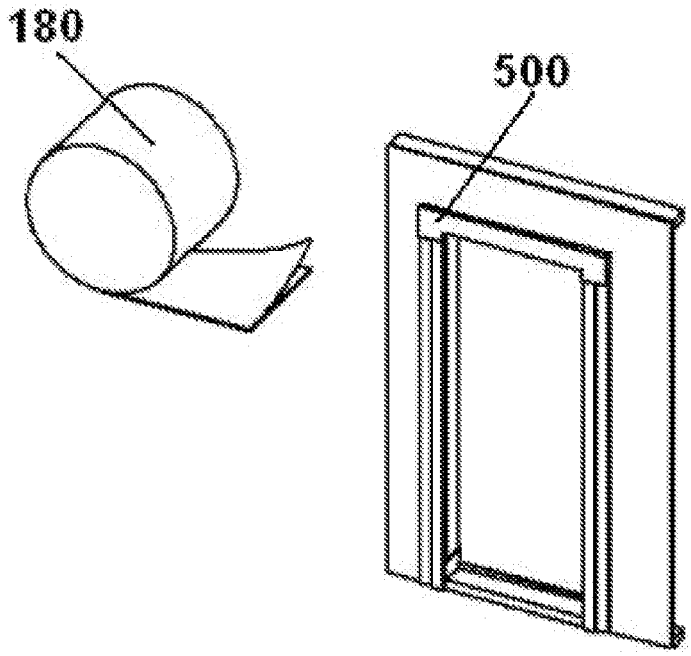

FIG. 1F shows the sixth step of a water management procedure. The window or door is installed so that a ⅛" gap is provided between the window or door and the rear portion of the sloping pan. For high wind conditions, the gap is sealed. Additional SAF is applied at the jamb for brick molding. The HeadFlash assembly 500 is installed by securing fasteners through slots in the end caps. The HeadFlash assembly should be installed over the top of the window and over the window jamb flashing in an overlapping shingle fashion. The assembly will prevent the water from intruding behind the window and behind the window jamb flashing and penetrating inside the building envelope. The HeadFlash assembly will direct the water outwardly, in the shortest path and will prevent the water from traveling laterally penetrating inside the building envelope, or behind the exterior cladding.

Figure 1G:
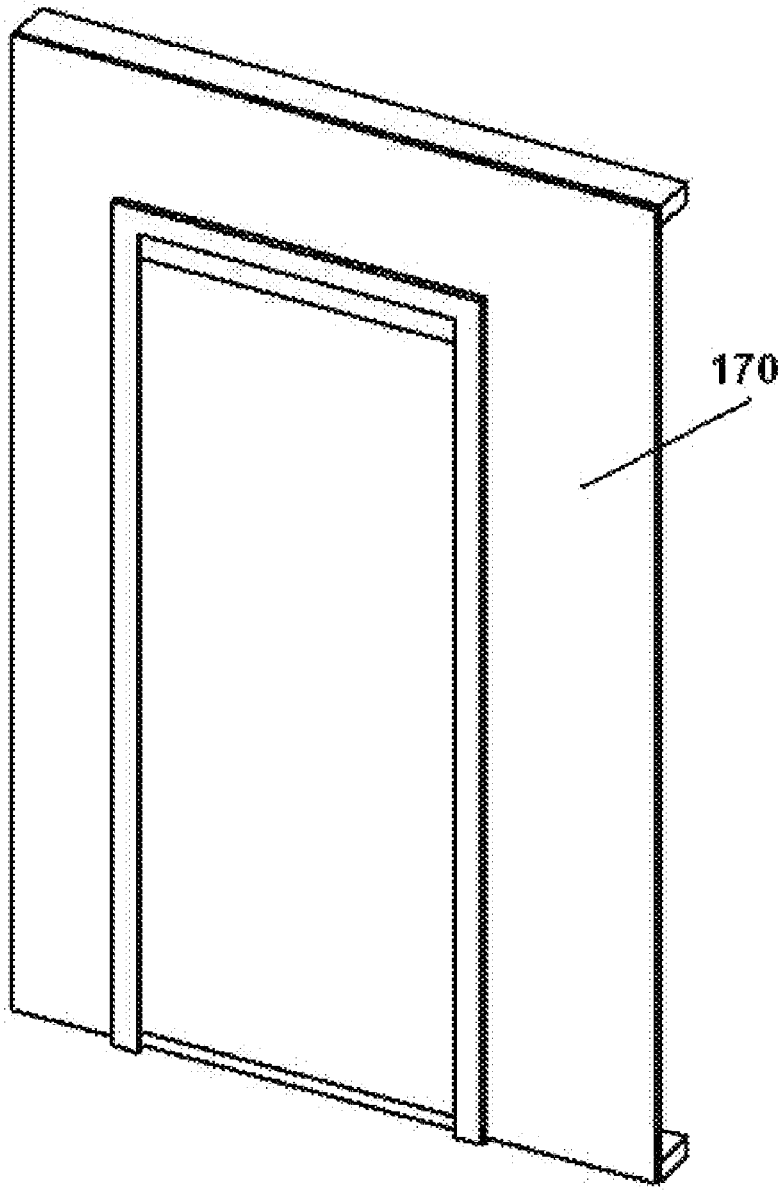

FIG. 1G shows the seventh step of a water management procedure. Waterproofing 170, such as installation of the exterior moisture barrier, is installed in shingle fashion over the jamb flashing and the HeadFlash assembly. Free drainage is maintained for the sill pan and the head flashing.

Figure 1H:
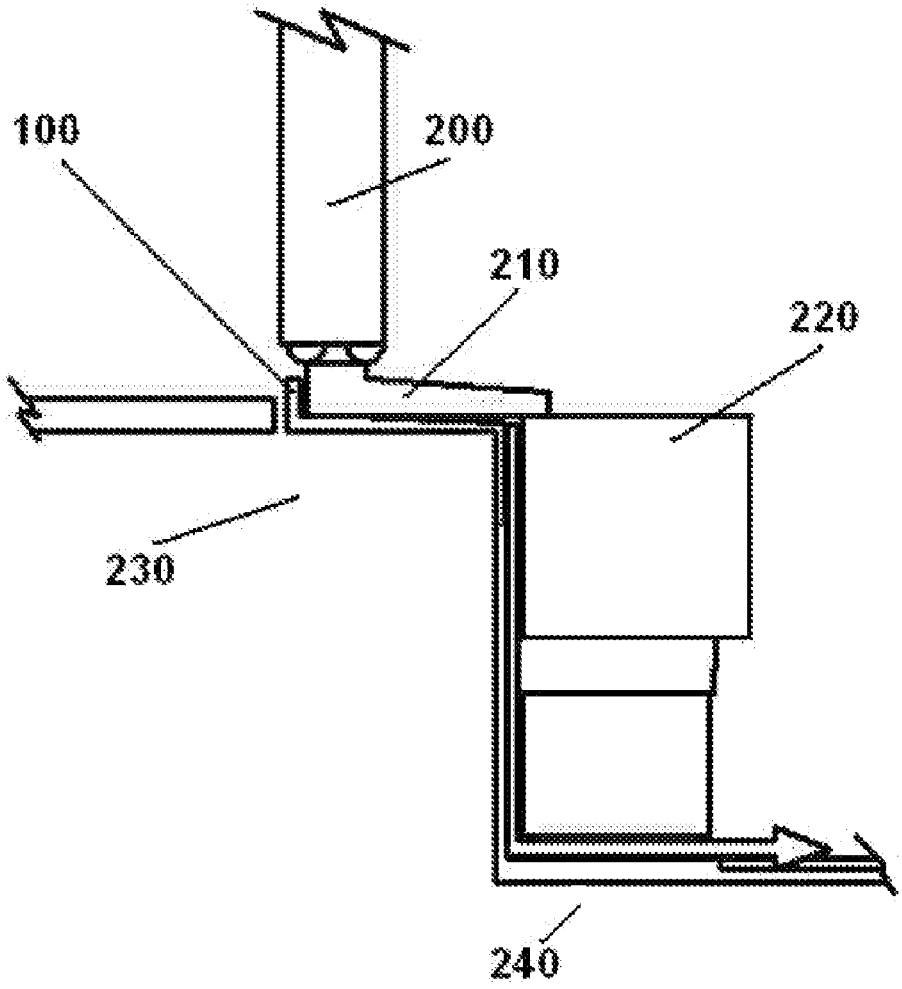

FIG. 1H shows a door drain detail for the water management procedure. The sloped sill pan 100 is shown installed between the door 200 and the door sill 210. A drainage path is maintained between the masonry veneer 220 and the foundation 230, such as by installing a ½" inch sisal rope on twelve inch centers. The path should be continued over a porch 240.

DETAILED DESCRIPTION OF EMBODIMENT

Head Flashing

Figure 2:
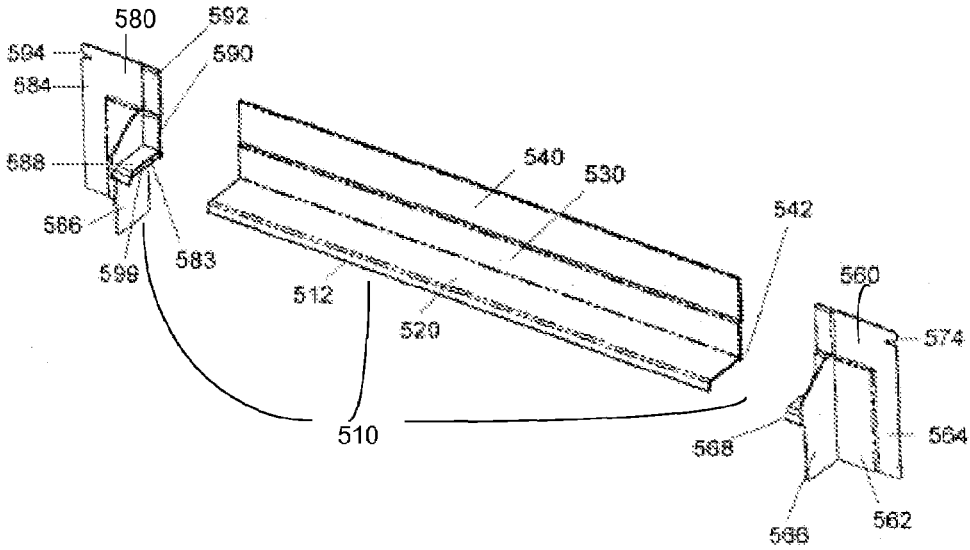
FIG. 2 is an exploded prospective view of one embodiment of a head flashing.

FIG. 2 is an exploded prospective view of one embodiment of a head flashing.

The head flashing assembly 500 is constructed of a center piece 510 which may be extruded, and two end caps 560 and 580 which are typically produced by molding such as injection molding.

The center piece includes a back flange 540 which has a recess 530 for receiving a window flange, has a front lip 512 and a base 520. A lower portion of the front lip is typically angled outward in order to serve as a drip edge to resist water weepage under the base.

The end cap 560 includes a nailing notch 574, a side flange 564 which includes a recess 562 for receiving the window flange, a perpendicular fin 566 which extends outwardly from the end cap, and an overlap section 568 for receiving the base section of the center unit. The overlap section 568 may include an upper overlap lip 569 (not shown) and a lower lip 563 (not shown) such that a portion of the base and front lip may be inserted between the upper overlap lip and the lower lip. A waterproof connection is typically established by gluing the end caps to the center section, such that edges of the base and front lip are glued into the overlap sections, and edge of the back flange is glued to the end cap.

The end cap 580 is symmetric to the first end cap, and in this view the rear section may be seen including the rear upright 592 and recess section 590 for overlapping the recess portion of the central base unit. The end cap 580 includes a nailing notch 594 in the side flange 584, a perpendicular fin 586, and an overlap section 588. The overlap section 588 may include an upper overlap lip 599 and a lower lip 583 such that a portion of the base and front lip may be inserted between the upper overlap lip and the lower lip.

The HeadFlash assembly is typically provided on top of the window or door and on top of jamb flashing so that the head flashing overlaps jamb flashing in a shingle fashion. The head flashing prevents water from going between the window and the building, and eventually finding its way into the structure.

In one embodiment, end caps on the head flashing prevent the water from going sideways and serve as a "dam" to the lateral movement of water. End caps may have different designs. For example the perpendicular "dams" may have various widths and heights above and below mid-point where extruded segments meet the End Caps. Head flashing also prevents the water from going behind the jamb flashing.

Figure 7:
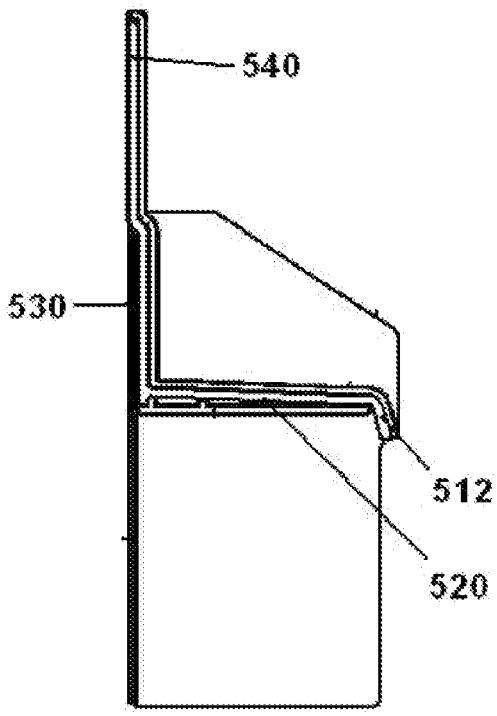
FIG. 7 is a side cross-section view of a center unit showing a slope of the base.

The head flashing preferably has a slope for draining the water. Referring to FIG. 7, in one example there is approximately a 5% slope from the rear of the jamb to the front of the jamb.

Figure 3:
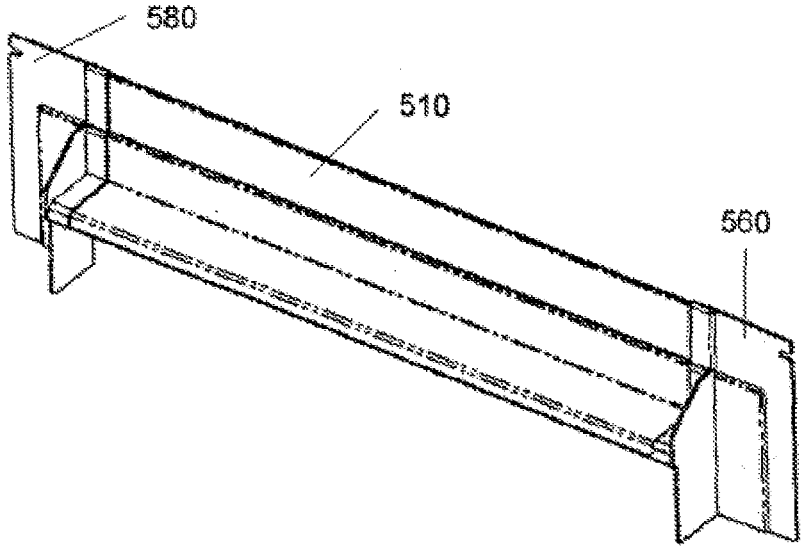
FIG. 3 is a front perspective view of an assembled unit including a center unit and two end caps.

FIG. 3 is a front perspective view of an assembled unit including the center unit 510 and the two end caps 580 and 580.

Figure 4:
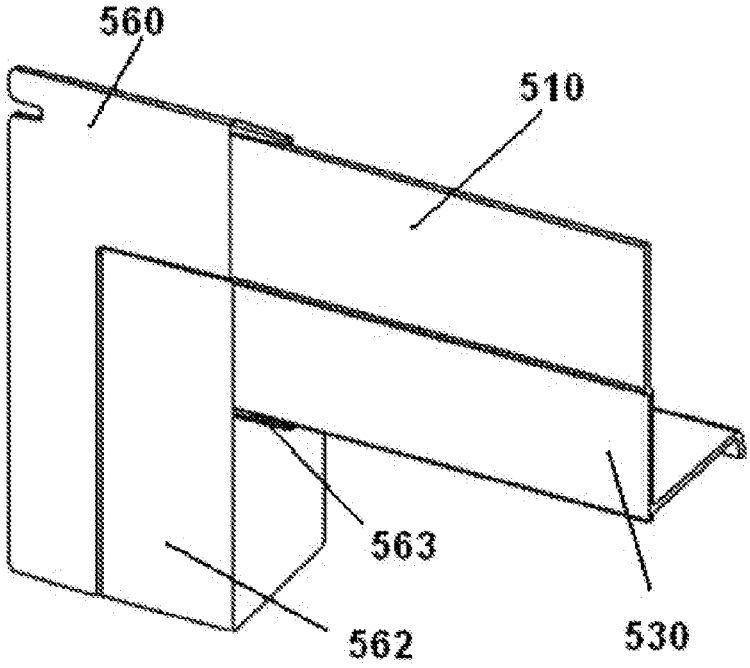
FIG. 4 is a rear view showing the connection between the center unit and an end cap, showing the recesses for the window flange.
Figure 6:
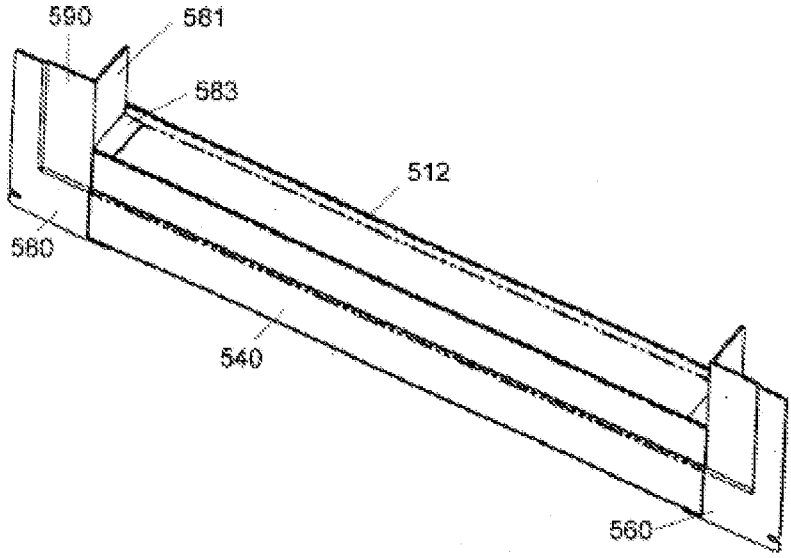
FIG. 6 is a rear view of the assembled center unit and end caps.

FIG. 4 is a rear view showing the connection between the center unit 510 and the end cap 560 showing the recesses for the window flange recesses 562 for the end cap and the recess 530 in the central unit. FIG. 6, which shows an inverted HeadFlash assembly, also shows a portion of the lower lip 583 of the end cap for receiving the base section of the center unit.

Figure 5B:
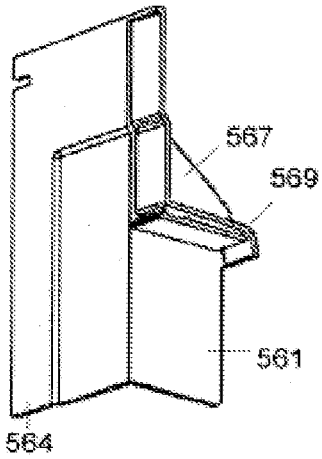
FIG. 5B is a rear perspective view of an end cap.
Figure 5A:
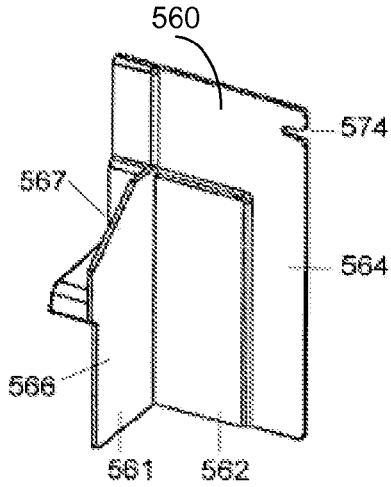
FIG. 5A is a front perspective view of an end cap.

FIG. 5A is a front perspective view of the end cap 560. FIG. 5B is a rear perspective view of the end cap 560.

EXAMPLE

FIG. 7 is a side cross-section view of a center unit 510 showing a 5% slope of the base in one embodiment. FIG. 7 illustrates a 1⅜" call size HeadFlash assembly for use over the top of a window or door to seal against water intrusion.

In this example, the base has a width of 1⅜ inches, and the back flange has a height of 2½ inches which includes a lower recessed portion for accepting a window flange, and an upper portion of 1 5/16". Other widths and heights may be provided as desired.

DETAILED DESCRIPTION OF EMBODIMENT

End Caps

Figure 8:
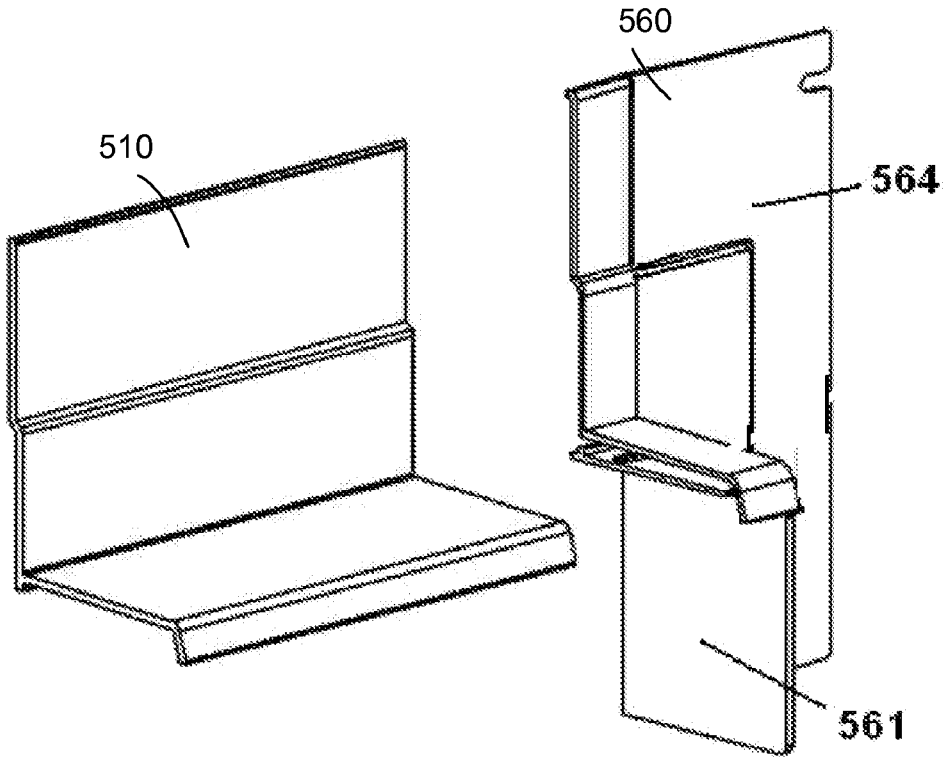
FIG. 8 is an exploded view of an end cap with only an upper portion of the perpendicular fin.

FIG. 8 is an exploded view of a HeadFlash assembly comprising an alternate design of an end cap. In this embodiment, the end cap 560 has a perpendicular fin with only a lower fin portion 561. No upper portion of the fin is provided in this embodiment. This design corresponds to some hand-made metal flashings which have provided only a lower portion of an end dam.

Figure 9:
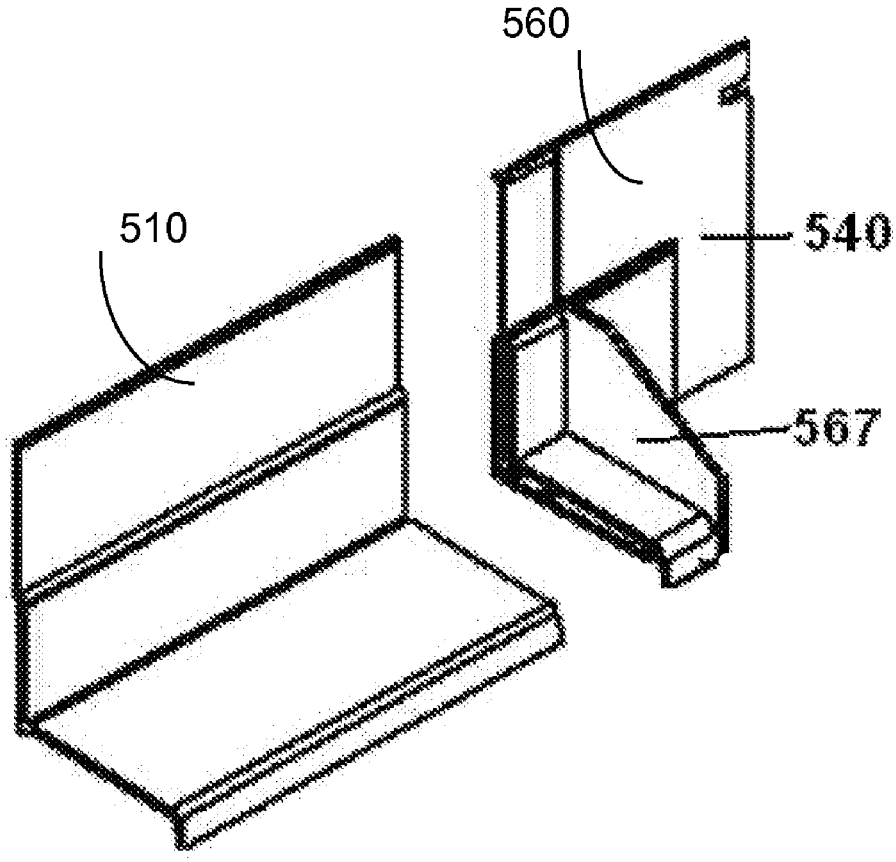
FIG. 9 is an exploded view of an end cap with only a lower portion of the perpendicular fin.

FIG. 9 is an exploded view of a HeadFlash assembly comprising an alternate design of an end cap. In this embodiment, the end cap 560 has a perpendicular fin with only an upper fin portion 567. No lower portion of the fin is provided in this embodiment of an end cap without a lower side upper dam.

Some window companies have provided a "drip cap" which consists of the middle extruded element similar to the head flashing described above without end caps. These drip caps are typically not sloped.

DETAILED DESCRIPTION OF EMBODIMENT

Reversible Head Flashing

Figure 10A:
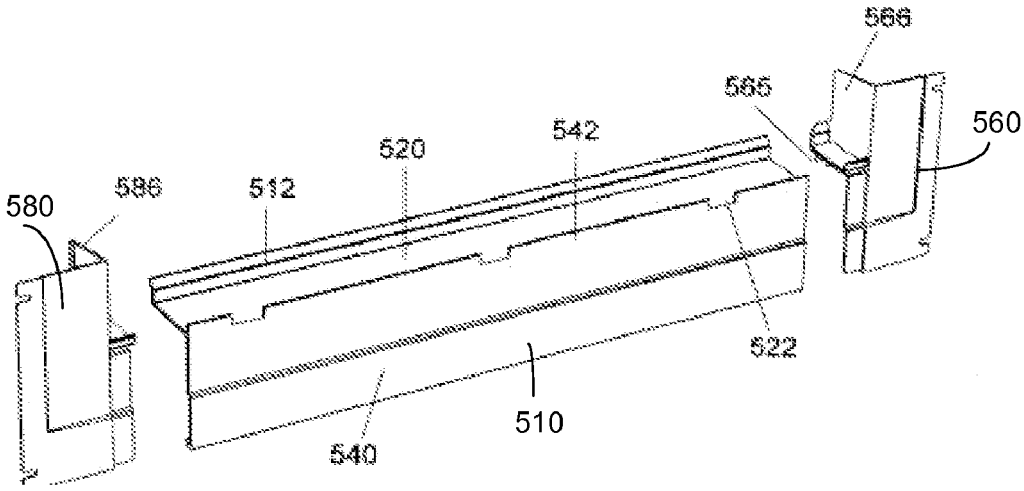
FIG. 10A is a front perspective exploded view of an inverted head flash assembly adapted for use as a sill pan.
Figure 10B:
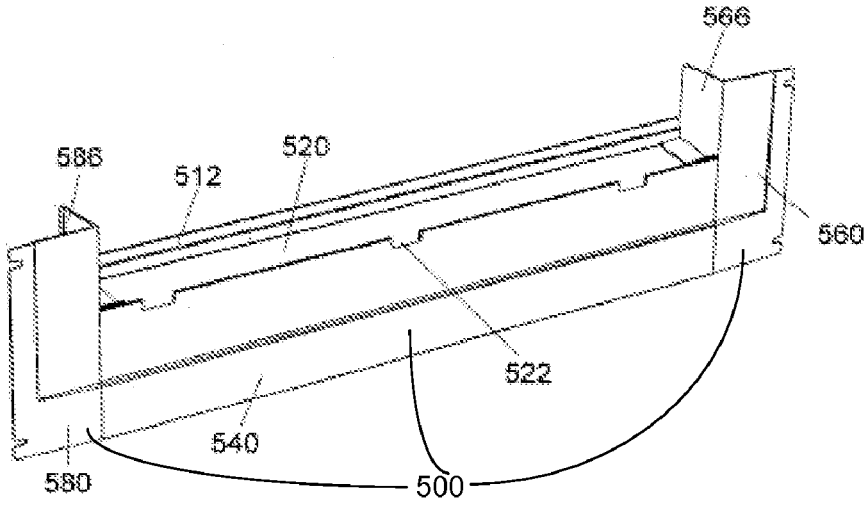
FIG. 10B is an assembled sill pan of FIG. 10A.

FIGS. 10A and 10B illustrate a head flashing that may be inverted. FIG. 10A is a front perspective exploded view of an inverted head flash assembly adapted for use as a sill pan.

In this embodiment, the head flashing assembly 500 may be inverted to serve as a sloping sill pan. The lower portion 542 of the rear flange 540 may be notched with a plurality of notches or slots 522 to permit water to drain from the base of the inverted center channel 520. The rear flange 540 serves as a front lip for the sill pan, and the front lip 512 of the head flashing serves as a rear wall for the sill pan.

The end cap 560 includes a perpendicular fin 566. A section of the top portion of the perpendicular fin 586 may be removed, such as by cutting or breakaway tab, in order to permit the end caps to be supported at a desired height above the sill and to provide a slope to the sill pan. A similar portion of the perpendicular fin 586 of end cap 580 has also been removed.

In some cases, it is desirable to include support ribs 565 integral to the bottom portion of the perpendicular fin 566, so that when the upper portion of the fin is removed, the support ribs stiffen the remaining portion of the fin and held support the weight of the window or door which is placed on the sill pan.

FIG. 10B is an assembled sill pan 500 of FIG. 10A.

Figure 11A:
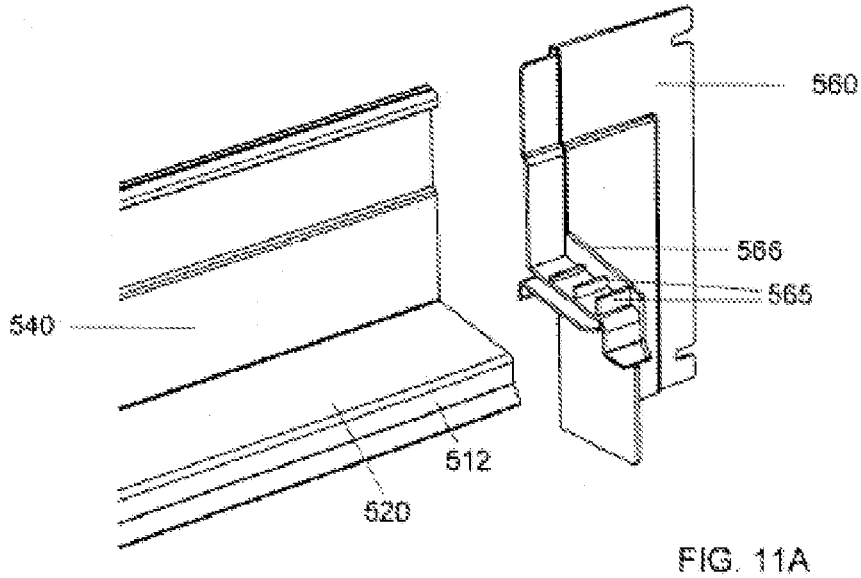
FIG. 11A is an exploded front perspective view of a portion of a head flashing device center section and an end cap.

FIG. 11A is an exploded front perspective view of a portion of a head flashing device center section 520 and an end cap 560 illustrating support ribs 565 and a perpendicular fin 566.

Figure 11B:
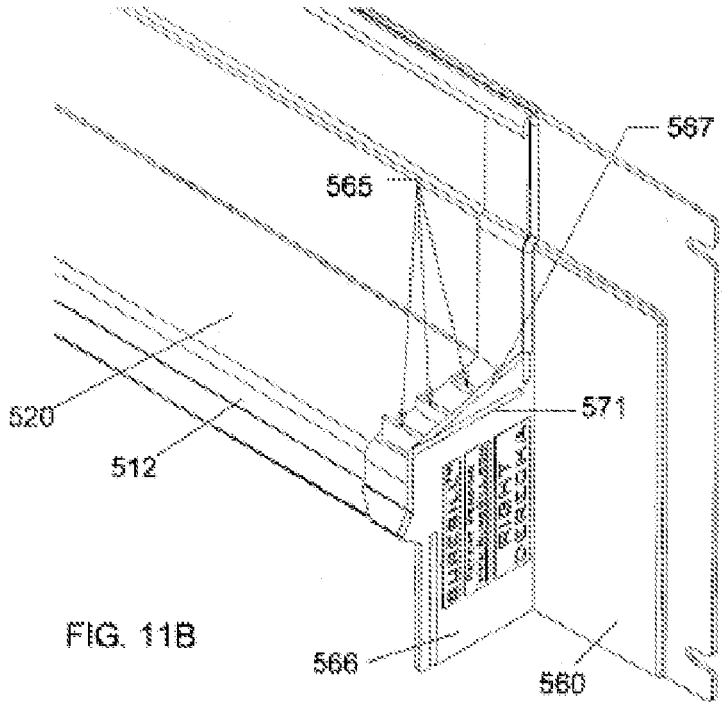
FIG. 11B is a side perspective view of an inverted end cap illustrating a cutoff line and reinforcing ribs provided on a perpendicular fin.

FIG. 11B is a side perspective view of an inverted end cap 560 illustrating a cutoff line 571 provided on a perpendicular fin 566. In this embodiment, a removable upper portion 567 of the perpendicular fin 566 may be snipped or cut along cut line 571. The cut line is located so that when the top portion 567 is removed, the remaining portion of the fin is properly positioned on a sill in order to permit the base of the sill pan to slope outwardly.

In this example, a plurality of support ribs 565 are provided between the overlap section 568 and the cut line 571. These support ribs provided additional support so that the end cap can bear the weight of a window or door.

Although the weight of a window or door is typically directed to the ends of the window or door, and will be supported by the end caps, it may be desirable in some cases to provide one or more additional center base supports (not shown) which may be attached to the bottom of the head flash center channel before inversion. Alternately, the base support may be inserted below portions of the center channel after the sill pan is installed. Typically, these supports will be glued in place.

EXAMPLE

Universal Flashing of HeadFlash 1-⅜" and Convertible Sill Pan Assembly

In this example, a nominal 1⅜" call size HeadFlash assembly is utilized over the top of a window or door to seal against water intrusion.

The base of the center channel extrusion is sloped to expel water away for the top of the window or door assembly.

The extrusion shape includes a recess to nest over the window nail flange to help maintain a low profile. This recess is extended into the end caps.

The top of the center channel extrusion is shaped to lock around the end caps to improve assembly. The front lip of the extrusion is flared outward to prevent water from wicking to the top of the window/door assembly.

Each end cap has provisions for a nailing to the underlying structure to retain the assembly prior to the installation of siding material. The end caps have provisions to allow blind mating with the extrusion to make assembly easy.

Figure 14:
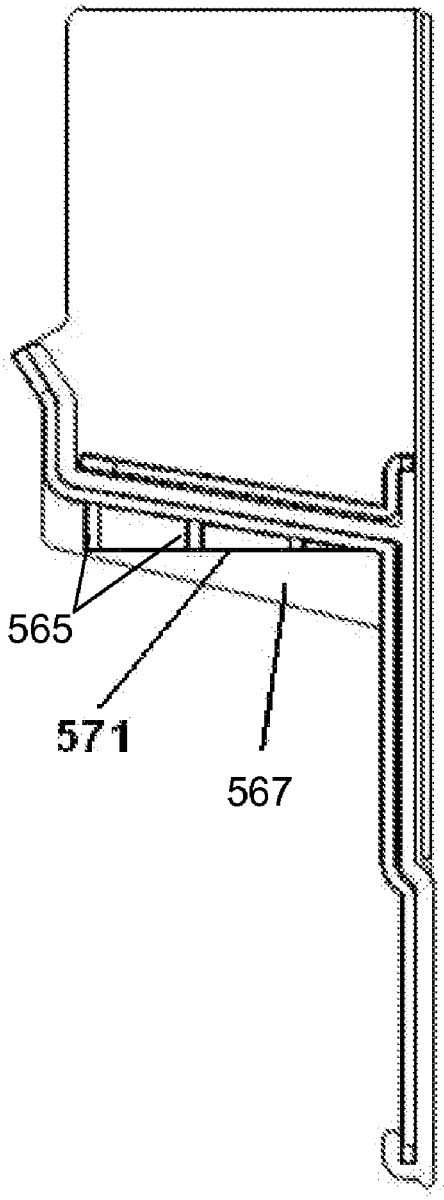
FIG. 14 is a side view of an inverted head flashing assembly for use as a sill pan.

The assembly can be inverted for use under a window or doorsill by adding drainage slots. FIG. 14 is a side view of the example inverted head flashing assembly 500 which has been adapted for use as a sill pan.

FIG. 14 shows a full size perpendicular fin on an end cap. Typically, this fin would be cut or broken along line 571 in order to shorten the fin so that the fin could support a sloping base of the sill pan. Additional support ribs 565 are provided on the lower portions of the perpendicular fins, so that the ribs help support the weight of a window or door.

Drain slots are added along the front lip of the extrusions to allow water to drain from under the window/door sill.

DETAILED DESCRIPTION OF EMBODIMENT

Arched Head Flashing

Figure 12A:
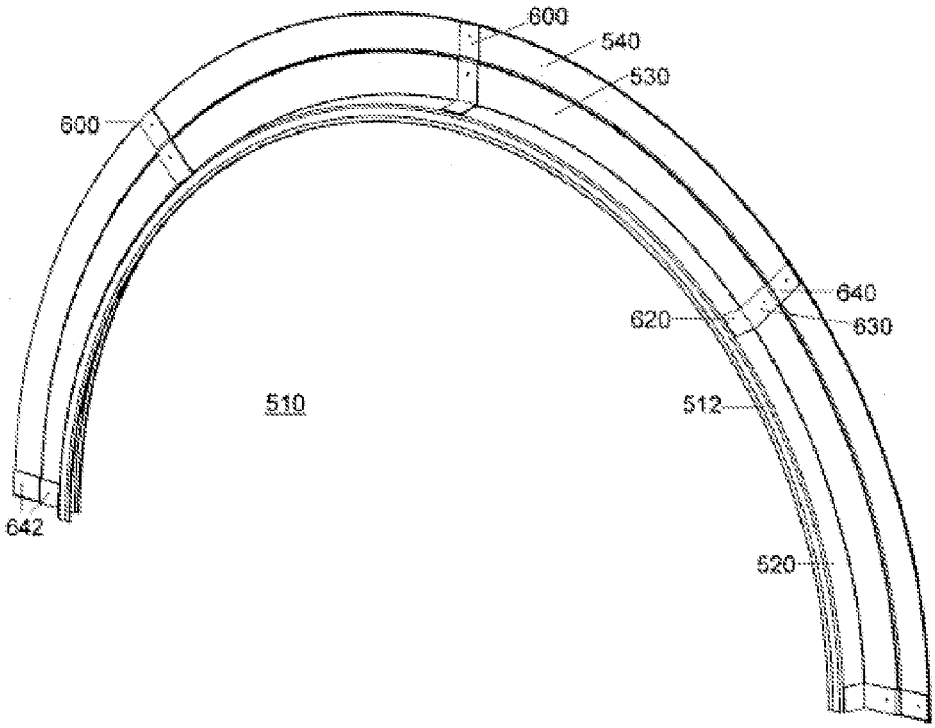
FIG. 12A is a front perspective view of an arched head flashing with installation brackets.

FIG. 12A is a front perspective view of an arched head flashing with installation brackets. FIG. 12C is a perspective view of a straight section of head flashing which may be arched to the desired shape of FIG. 12A. Typically, the head flashing is provided as a straight section that may be bent to a desired shape.

In this embodiment, the arched head flashing assembly includes an extruded head flashing and installation brackets. The extruded head flashing includes a base 520 which is typically provided as a rigid plastic material, a front lip 512 which is substantially flexible, and a back flange 540 which is substantially flexible. The back flange may include a lower recessed portion which is designed to overlap a window nailing flange. The front lip may include a drip edge.

In this embodiment, a plurality of brackets 600 are provided so that the extruded head flashing may be nailed or screwed to the jamb. Since the head flashing material may be a flexible plastic, it is desirable to provide a more rigid material to resist tearing and to hold the head flashing in proper position. FIG. 12D is a perspective view of an installation bracket as shown in FIG. 12A. In this example the bracket includes a base 620, a back flange 640 which may include a back flange offset 630. The bracket may also include preformed fastener holes 642. The bracket shape matches the base and back flange shape of the head flashing, but does not typically extend over the front lip of the head flashing.

Figure 12B:
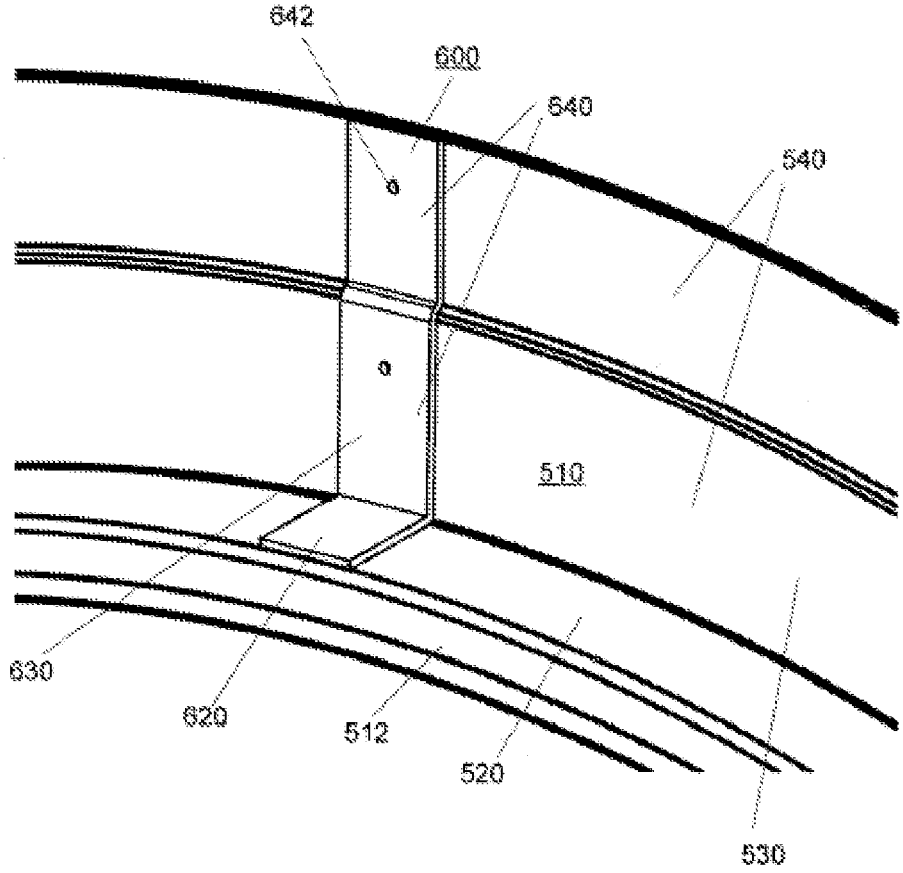
FIG. 12B is a detailed front perspective view of the arched head flashing of FIG. 12A.
Figure 12C:
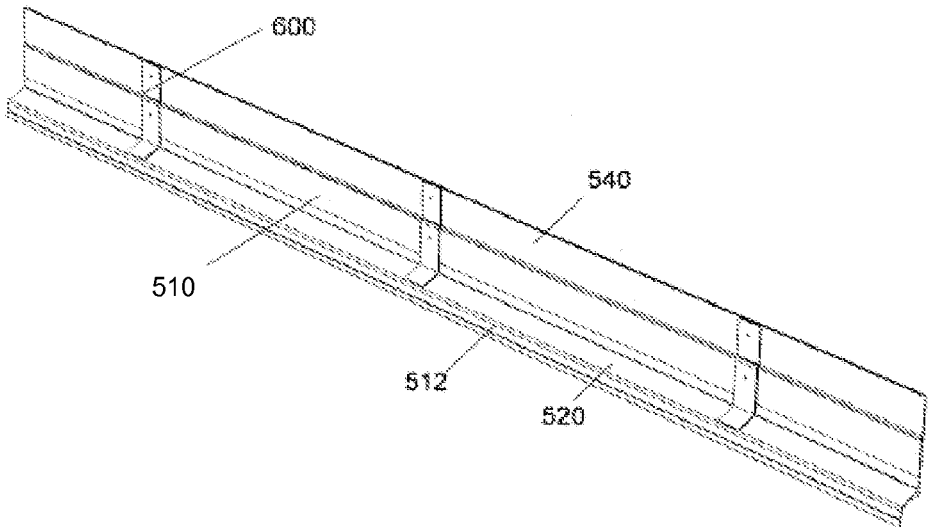
FIG. 12C is a perspective view of a straight section of head flashing which may be arched to the desired shape of FIG. 12A.
Figure 12D:
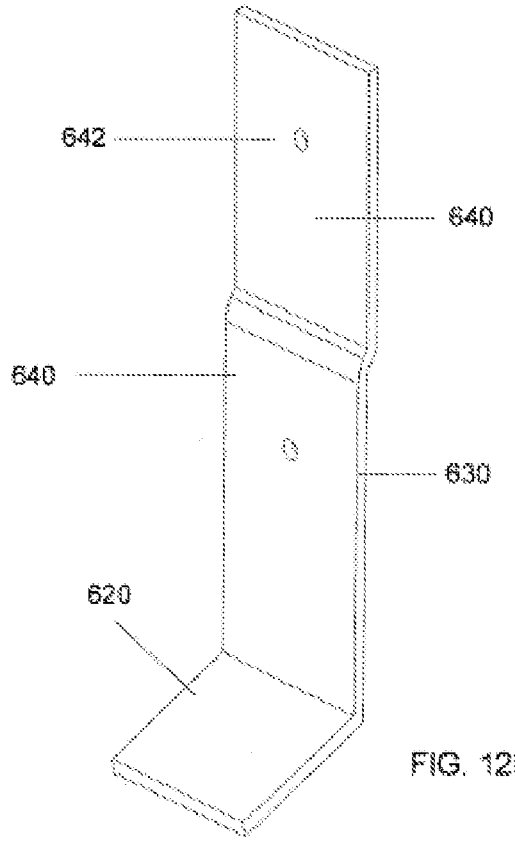
FIG. 12D is a perspective view of an installation bracket as shown in FIG. 12A.

FIG. 12B is a detailed front perspective view of the arched head flashing of FIG. 12A. In this example, the bracket has a constant width, and may be formed by extrusion and cutting the bracket to a desired width. In other examples, the bracket may be provided as more of a pie shape with a relatively narrow base and a wider back flange in order to provide support along the back flange without interfering with the desired base curvature.

Figure 12E:
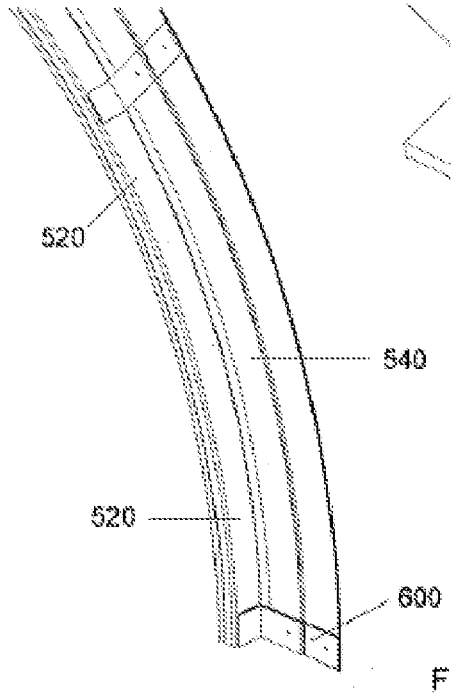
FIG. 12E is a perspective view of an end portion of the arched installation of the head flashing of FIG. 12A

FIG. 12E is a perspective view of an end portion of the arched installation of the head flashing of FIG. 12A. In this example, the end portions of the arched head flashing extend two to three inches below the arched portion of the window so that the end portions overlap the bottom corners of the arched portion of the window or door.

EXAMPLE

1.00" Call Size HeadFlash-Flex™ Extrusion Assembly

In this example, a HeadFlash-Flex™ extrusion assembly is provided with a one inch wide base 520.

The extrusion assembly is utilized over the top portion of a curved top window or door to seal against water intrusion. The assembly is manufactured as a straight extrusion and formed on installation to fit the particular curve of the window or door assembly. The assembly can be provided in other call sizes as required. Installation brackets are attached to the extrusion assembly on 10 to 18 inch centers so that the assembly is ready to be cut and installed.

The extrusion assembly is cut to a desired length to overlap the arched portion of the window or door and to provide an additional two to three inches overlap on both sides of the window or door.

The midpoint of the cut extrusion assembly is marked and positioned over the top of the arched portion of the window or door. The extrusion assembly is then formed over the right portion of the window or door, from the top center point to the lower right corner of the arched portion, and secured with nails or screws through the installation brackets. An additional installation bracket may be provided for use at the end of the extrusion assembly. In other embodiments, the end of the extrusion assembly may be nailed without the installation bracket. The extrusion assembly is then formed over the left portion of the window or door from the top center point to the lower left corner of the arched portion, and secured with nails or screws through the installation brackets.

The base 520 of the extrusion is a horizontal web which projects from wall surface, and is sloped to expel water away from the top of the window or door.

In some embodiments, the extrusion is fabricated to allow it to flex around the curved surface by using a combination of rigid and flexible PVC or suitable material. The central section utilizes a rigid material while the upper flange and outer drip flange are made of flexible material. A rigid material is generally defined as a material that will not deflect more than a few inches under its own weight when a three foot section is held outstretched in one hand. A flexible material cannot be held in an outstretched position for more than a few inches without drooping.

In one embodiment, the rigid portion is PVC having a hardness in the range of Shore 60D to Shore 90D, and the flexible portion is PVC having a hardness in the range of Shore 30A to shore 90A.

The rigid central section maintains the required sloped surface of the base. The upper flexible back flange will easily conform to a desired arched window radius but tends to withdraw from the wall surface. The installation brackets are stabilizing clips made of rigid material may be attached to the back flange that can be nailed to the wall to avoid this problem. The clips are shown at intervals of approximately every 12 inches but the spacing could be more or less depending on the degree of curve being covered. The clips are rigid and can have predrilled with holes for locating nails. The flexible extrusion material under the clips seals around the fasteners against any leakage. The clips can be bonded to the extrusion at the manufacture to facilitate installation. Adjusting the size of the clip to fit other extrusions can create other call sizes of the HeadFlash-Flex™.

DETAILED DESCRIPTION OF EMBODIMENT

Arched Head Flashing With Stiff and Flexible Portions

Figure 13:
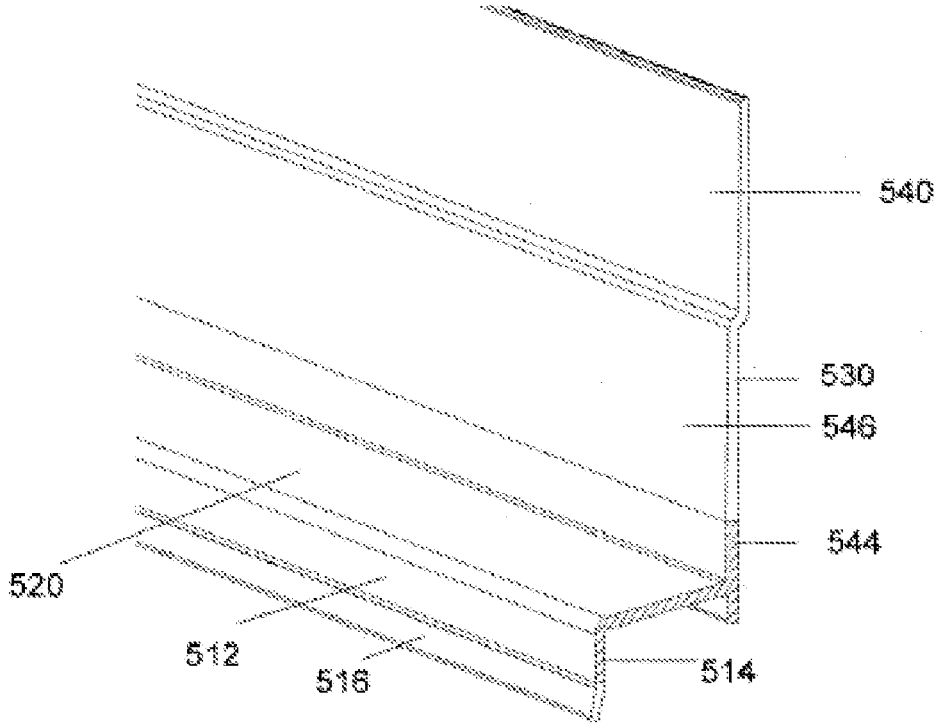
FIG. 13 is a side perspective view of a head flashing with both rigid and flexible portions.

FIG. 13 is a side perspective view of a head flashing with both rigid and flexible portions. In this embodiment, the base 520 is formed of a rigid plastic. The front lip 512 includes a first rigid portion 514 in proximity to the base, and a second flexible portion 516. The back flange 540 includes a first rigid portion 544 in proximity to the base, and a second flexible portion 546.

In one example, the rigid portions of the front lip and the back flange have a height of about ⅛ to ⅜ inches in order to provide some stiffness and resistance while still permitting the head flashing to be bent smoothly into a desired arch. If these rigid portions are not present, then the head flashing may be too flexible to hold the desired shape. If these rigid portions are too long, then the head flashing may become too stiff to bend smoothly.

In one example, this combination of rigid and flexible portions is provided by co-extruding both a rigid plastic and a flexible plastic.

DETAILED DESCRIPTION OF EMBODIMENT

Arched Head Flashing With Flexible portion overlapping stiff portion

In this embodiment, the head flashing includes both rigid and flexible portions where the flexible material overlaps at least a portion of the rigid portions of the front lip and back flange. In this embodiment, the base 520 is formed of a rigid plastic. The front lip 512 includes a first rigid portion 514 in proximity to the base, and a second flexible portion 516 which overlaps at least a portion of the first rigid portion 514. The back flange 540 includes a first rigid portion 544 in proximity to the base, and a second flexible portion 546 which overlaps at least a portion of the first rigid portion 544.

In this example this combination of rigid and overlapping flexible portions is provided by co-extruding both a rigid plastic and a flexible plastic.

In another example, the flexible material may overlap all of the rigid portions.

What is claimed is:

1. A head flashing assembly for windows and doors having a front surface and a rear surface, the head flashing assembly comprising an elongated center section having a generally Z-shaped cross section, a first end and a second end, the center section comprising a back flange extending from the first end to the second end, a base extending from the first end to the second end, the base having a rear edge along the back flange, and a front edge, such that the front edge is lower than the back edge so that the base is sloped downwards with respect to the back flange, and a front lip along the front edge of the base;

a first end cap attached to the first end of the center section, the first end cap comprising a side flange extending outwardly from the rear of the first end cap, a waterproof connection to the first end of the center section comprising an overlap section which overlaps a portion of the base, lip, and back flange of the first end of the center section , and a perpendicular fin, perpendicular to the side flange, having a lower section extending below the first end of the base and an upper section extending above the first end of the base;

a second end cap attached to the second end of the center section, the second end cap comprising a side flange extending outwardly from the rear of the second end cap, a waterproof connection to the second end of the center section comprising an overlap section which overlaps a portion of the base, lip, and back flange of the second end of the center section, and a perpendicular fin, perpendicular to the side flange, having a lower section extending below the second end of the base and an upper section extending above the second end of the base.

2. The head flashing assembly of claim 1 wherein the side flange further comprises a nailing notch.

3. The head flashing assembly of claim 1 wherein the first end cap further comprises a recess for receiving a window flange.

4. The head flashing assembly of claim 1 wherein the back flange further comprises an upper portion offset from the lower portion, such that the lower portion may conform to a window nailing flange.

5. The head flashing assembly of claim 1 wherein the first end cap further comprises a a rear upright.

6. The head flashing assembly of claim 1 wherein the first end of the center section base is glued into the overlap lip.

7. The head flashing assembly of claim 1 wherein the head flashing assembly may be installed in a first upright orientation to serve as a head flashing for a window or door; and the head flashing assembly may be installed in a second inverted orientation to serve as a sloping sill pan for the window or door.

* * * * *